US007806509B2

(12) United States Patent
Sakurai

(10) Patent No.: US 7,806,509 B2
(45) Date of Patent: Oct. 5, 2010

(54) INK-JET IMAGE FORMING APPARATUS AND WASTE-INK PROCESSING METHOD

(75) Inventor: Hisaki Sakurai, Aichi-ken (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 755 days.

(21) Appl. No.: 11/804,273

(22) Filed: May 17, 2007

(65) Prior Publication Data

US 2007/0268331 A1 Nov. 22, 2007

(30) Foreign Application Priority Data

May 18, 2006 (JP) ..... 2006-138775

(51) Int. Cl.
*B41J 2/165* (2006.01)

(52) U.S. Cl. ..... 347/36; 347/22; 347/25

(58) Field of Classification Search ..... 347/22–36
See application file for complete search history.

(56) References Cited

U.S. PATENT DOCUMENTS 6,886,908 B2 * 5/2005 Takahashi et al. ..... 347/34

FOREIGN PATENT DOCUMENTS

| | | |
|---|---|---|
| JP | 3065059 | 5/2000 |
| JP | 2002-211007 | 7/2002 |
| JP | 2004-284058 | 10/2004 |

* cited by examiner

*Primary Examiner*—Juanita D Stephens
(74) *Attorney, Agent, or Firm*—Eugene LeDonne; Joseph W. Treloar; Frommer Lawrence & Haug LLP

(57) ABSTRACT

An ink-jet image forming apparatus includes a recording head in which a plurality of nozzle groups jetting an ink is formed, a carriage which is mounted on the recording head, and which is capable of reciprocating in a predetermined direction, a waste-ink tank which stores the ink discharged from a the nozzle groups, and an air guide section which expedites evaporation of waste-ink by guiding a flow of air generated by the carriage movement to the waste-ink tank. Accordingly, it is possible to make the waste-ink tank compact without reducing an amount to be received of the waste-ink.

12 Claims, 5 Drawing Sheets

INK-JET IMAGE FORMING APPARATUS AND WASTE-INK PROCESSING METHOD

CROSS REFERENCE TO RELATED APPLICATION

The present application claims priority from Japanese Patent Application No. 2006-138775 filed on May 18, 2006, the disclosure of which is incorporated herein by reference in its entirety.

BACKGROUND OF THE INVENTION

1. Field of the Invention

The present invention relates to an ink-jet image forming apparatus which adheres ink droplets to a surface of a recording medium by jetting the ink droplets on to the recording medium, and records characters and diagrams and the like, and a waste-ink processing method (waste-ink disposal method).

2. Description of the Related Art

An ink-jet image forming apparatus expresses characters and diagrams and the like by jetting droplets of an ink toward a recording medium such as a plain paper, and forming a plurality of dots by adhering the droplets of ink on the recording paper. The droplets of ink are jetted on to the recording medium at a high speed from a plurality of fine nozzles formed in a nozzle surface of a recording head. When the nozzles are blocked by dust, a thickened ink and the like, and when an air bubble is generated inside the nozzle, there is a malfunction such as a jetting defect and a decline in accuracy of landing of the droplets of the ink, and an unevenness in an amount of ink jetted, and an image quality is declined.

For avoiding this, a maintenance and recovery of a jetting function by discharging impurities inside the nozzle, by sucking or jetting the ink periodically from each nozzle group has been facilitated. The waste-ink which is discharged from the nozzle is sent to a waste-ink tank which is provided in the ink-jet image forming apparatus, and is absorbed in an ink absorbing material which is accommodated in the waste-ink tank. Since the waste-ink is stored in a state of being absorbed in the ink absorbing material in the waste-ink tank, a leakage of the waste-ink is prevented, and carrying of the image forming apparatus becomes easy.

SUMMARY OF THE INVENTION

Since it is necessary to design this ink absorbing material such that it is capable of receiving all the waste-ink which is generated during a guarantee period of the product, in many cases, an ink absorbing material of a large size is used. Therefore, the waste-ink tank occupies a large space inside the product, and imparts a substantial constraint on a design etc. When the ink absorbing material is let to be replaceable, and changed appropriately, it is possible to use a small ink absorbing material, but it is necessary to change the ink absorbing material frequently, and the maintenance becomes a troublesome task. Further, from a cost point of view, in the former, large-size ink absorbing material hinders a cost reduction, and the latter, even though small, since a large number of ink absorbing materials are necessary, it is difficult to facilitate the cost reduction.

In view of this, in Japanese Patent Application Laid-open No. 2002-211007 (Pages 2 and 3, and FIGS. 1 to 4), an ink-jet image forming apparatus, in which a heating mechanism such as a heater for heating the waste-ink is provided to improve a waste-ink receiving capacity of the waste-ink tank by enhancing drying, has been proposed. Accordingly, it is possible to reduce a size of the waste-ink tank.

However, the abovementioned ink-jet image forming apparatus requires a heating mechanism which is provided separately, or a heat source such as a motor which is mounted in the ink-jet image forming apparatus.

An object of the present invention is to provide an ink-jet image forming apparatus in which it is possible to facilitate a size reduction of the waste-ink tank without a need to have a heat source, and to provide a waste-ink disposal method.

According to a first aspect of the present invention, there is provided an ink-jet image forming apparatus which forms image by discharging an ink onto a medium, comprising:

a recording head in which a plurality of nozzles which jet the ink is formed;

a carriage which has the recording head mounted thereon, and which moves reciprocally in a predetermined direction;

a waste-ink tank which stores the ink discharged from the nozzles; and a guide section which guides an air flow, generated when the carriage moves to the waste-ink tank to bring the air flow into contact with the ink stored in the waste-ink tank.

According to a first aspect of the present invention, since the guide section which guides the air flow generated due to the movement of the carriage is provided to the ink-jet image forming apparatus, it is possible to expedite evaporation of the waste-ink by bringing positively the ink (waste-ink) stored in the waste-ink tank in contact with the air. Therefore, it is possible to improve a receiving capacity of the waste-ink tank and to make the waste-ink tank small sized. Besides, since it is possible to expedite the evaporation of the waste-ink by using the flow of air generated due to the movement of the carriage, there is no need of a heat source for heating unlike a case of evaporating the waste-ink by heating.

In the ink-jet image forming apparatus of the present invention, since it is possible to improve a waste-ink receiving capacity of the ink tank, it is possible to reduce the size of the waste-ink tank. Therefore, there is an increase in a degree of freedom such as designing, and it is possible to provide an ink-jet image forming apparatus having a highly attractive feature, which is compact and have a superior design.

In the ink-jet image forming apparatus of the present invention, the guide section may include an air blowing passage which has a substantially cylindrical shape, and of which one end faces a traveling route in which the carriage reciprocally moves and the other end of which faces the waste-ink tank.

In this case, since the air blowing passages facing the traveling route (traveling passage) and the waste-ink tank respectively are formed inside the guide section, it is possible to guide efficiently the air flow generated by the carriage movement to the waste-ink tank. Therefore, it is possible to expedite the evaporation of the waste-ink. Moreover, since the waste-ink stored in the waste-ink tank is susceptible to be evaporated, it is possible to reduce further the size of the waste-ink tank, and to improve the attractive feature of the product as the designing and the design becomes easy.

In the ink-jet image forming apparatus of the present invention, the air blowing passage may be arranged at an end of the traveling route, or at an extension of the traveling route such that the one end is directed in the predetermined direction.

In this case, since the one end of the air blowing passage is in a state of facing carriage in the scanning direction, it is possible to guide efficiently the air flow generated by the movement of the carriage to the waste-ink tank, and to expedite the evaporation of the waste-ink. Moreover, since the waste-ink stored in the waste-ink tank is susceptible to be evaporated, it is possible to reduce further the size of the waste-ink tank, and to improve the attractive feature of the product as the designing and the design becomes easy.

The ink-jet image forming apparatus of the present invention may further include a cover which covers whole of the traveling route of the carriage together with the carriage, and the one end of the air blowing passage of the guide section may communicate with an inside of the cover.

In this case, in the ink-jet image forming apparatus, since the cover which covers the traveling route of the carriage together with the carriage, it is possible to suppress diffusion of the air flow generated by the movement of the carriage. Therefore, it is possible to guide the air flow more efficiently to the waste-ink tank through the guide section, and to expedite the evaporation of the waste-ink. Accordingly, it is possible to evaporate the waste-ink efficiently.

The ink-jet image forming apparatus of the present invention may further include a transporting member in which a transporting surface, which faces the carriage and on which the medium is transported, is formed, and the cover may be positioned close to the transporting surface, and the cover and the transporting surface may be combined to form a second air blowing passage, which is elongated in the predetermined direction and which communicates with the air blowing passage of the guide section.

In this case, since the second air blowing passage is formed by the cover and the transporting surface in combination, an air blowing passage which is highly obstructive is formed along the direction of movement of the carriage. Therefore, it is possible to guide, the air flow generated by the movement of the carriage, to the waste-ink tank more efficiently, and it is also possible to expedite the evaporation of the waste-ink. Accordingly, it is possible to evaporate the waste-ink efficiently.

The ink-jet image forming apparatus of the present invention may further include an ink cartridge which is arranged outside the cover; and a flexible tube through which the ink in the ink cartridge is supplied to the recording head, and which connects the ink cartridge arranged outside the cover and the recording head arranged inside the cover.

In this case, since the ink cartridge is arranged on the outside the cover, it is possible to improve a degree of freedom of arrangement of the ink cartridge. Moreover, even in this case, since it is possible to connect the ink cartridge and the recording head by using the flexible tube, it is possible to expedite the evaporation of the waste-ink. In this manner, even when the ink cartridge is arranged outside the carriage, it is possible to evaporate the waste-ink efficiently.

In the ink-jet image forming apparatus of the present invention, the waste-ink tank may have a container and an absorbing body which is porous and which is accommodated in the container.

In this case, since the waste-ink tank has the absorbing body which is porous, it is possible to expedite the waste-ink and air to make a contact by absorbing the waste-ink in the absorbing body which is porous and having a wide (large) surface area, and to expedite the evaporation of the waste-ink. Therefore, it is possible to reduce the size of the waste-ink tank, and to improve the attractive feature of the product. Moreover, since the waste-ink is not leaked even when the main body is tilted, the handling of the ink-jet image forming apparatus becomes easy.

The ink-jet image forming apparatus of the present invention, may further include a maintenance unit which is arranged at an end of the traveling passage in which the carriage moves reciprocally, the maintenance unit recovering a jetting function of the recording head by a purge process in which the ink is sucked by the maintenance unit or the ink is discharged to the maintenance unit; and a waste-liquid discharge passage which discharges the ink discharged from the maintenance unit to the waste-ink tank.

In this case, since the ink-jet image forming apparatus includes the maintenance unit which receives the ink discharged by the purge process, and the waste-ink discharge passage which discharges the ink discharged from the maintenance unit to the waste-ink tank, it is possible to store a large amount of waste-ink discharged by the purge process, in a small-sized waste-ink tank. Therefore, it is possible to provide the ink-jet image forming apparatus of the present invention with a waste-ink tank which is small sized, and which is capable of receiving the large amount of waste discharged by the purge process.

The ink-jet image forming apparatus of the present invention may further include a body cover which covers the recording head, the carriage, the waste-ink tank, and the guide section. In this case, since the ink-jet image forming apparatus includes the body cover, it is possible to reduce an effect of an environment outside the ink-jet image forming apparatus.

In the ink-jet image forming apparatus of the present invention, the guide section may include a main portion which is extended in the predetermined direction to cover the carriage, and a blowing portion which is extended in the predetermined direction from one end of the main portion toward the waste-ink tank. In this case, since the guide section has the main portion and the blowing portion, it is possible guide efficiently the air flow generated by the movement of the carriage, by using the main portion, and it is also possible to blow the air efficiently from the blowing portion to the waste-ink tank. Therefore, it is possible to expedite evaporation of the waste-ink in the waste-ink tank.

In the ink-jet image forming apparatus of the present invention, the blowing portion of the guide section may be extended up to an inside of the container of the waste-ink tank, or the blowing portion of the guide section may be inserted into the absorbing body accommodated in the container. In any of the cases, since the blowing portion is extended up to the inside of the waste-ink tank, it is possible to blow efficiently the air from the blowing portion, on the absorbing body, and to expedite evaporation of the waste-ink.

According to a second aspect of the present invention, there is provided a waste-ink processing method for processing a waste-ink in an ink-jet image forming apparatus including a carriage which is capable of reciprocating in a predetermined direction, a recording head which is provided on the carriage and in which a plurality of nozzles is formed, and a waste-ink tank which stores the waste-ink discharged from the nozzles, the method including generating an air flow by moving the carriage; and guiding the air flow to the waste-ink tank to bring the air flow in contact with the waste-ink stored in the waste-ink tank.

According to the waste-ink processing method of the present invention, evaporation of the waste-ink stored in the waste-ink tank is expedited, and it is possible to facilitate a size reduction of the waste-ink tank. Therefore, it is possible to improve a capacity of receiving the waste-ink of the waste-ink tank, and to improve the attractive feature of the product by reducing the size of the waste-ink tank, and making the designing and the design easy.

DETAILED DESCRIPTION OF THE PREFERRED EMBODIMENTS

Figure 1:
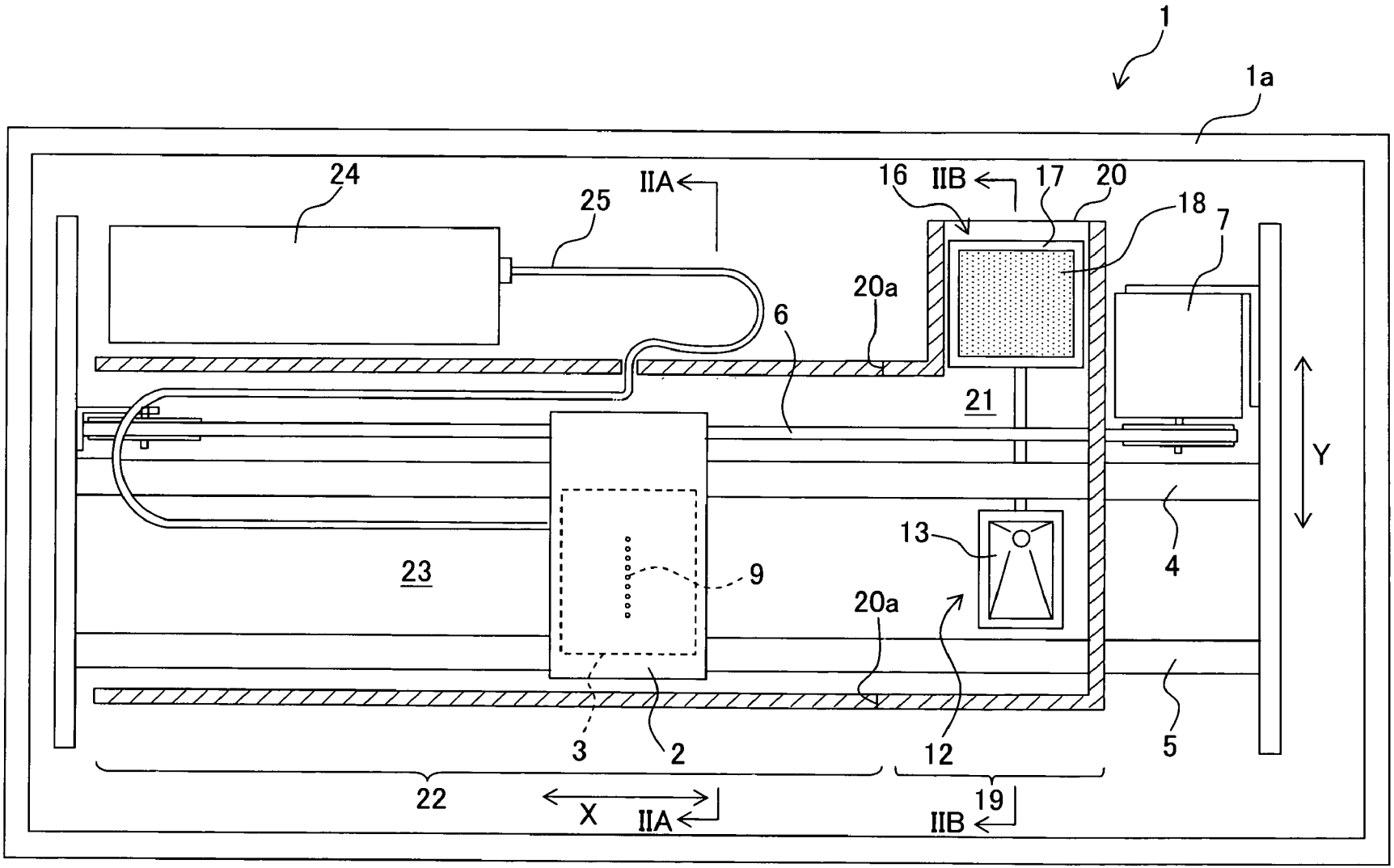
FIG. 1 is a schematic plan view showing an embodiment of an ink-jet image forming apparatus according to the present invention.

An embodiment of an ink-jet image forming apparatus of the present invention will be described below with reference to the accompanying diagrams. FIG. 1 shows a schematic plan view of an ink-jet image forming apparatus 1, and FIGS. 2A and 2B show a cross-sectional view taken along a line IIA-IIA in FIG. 1, and a cross-sectional view taken along a line IIB-IIB in FIG. 1 respectively.

As shown in FIG. 1, the ink-jet image forming apparatus (ink-jet printer) 1 includes mainly a body cover 1A, a carriage 2, a recording head 3, a pair of guide members 4 and 5, an endless belt 6, a drive unit 7, a maintenance unit 12, and a waste-ink tank 16. The carriage 2 also functions as a head holder on which the recording head 3 is mounted, and which reciprocates in a main scanning direction shown by an arrow X in the diagram. The carriage 2 is provided to bridge the pair of guide members 4 and 5 arranged to be isolated in a secondary scanning direction (Y direction in FIG. 1). The carriage 2 is driven by the drive unit 7 and the endless belt 6 which is connected to the drive unit 7, and reciprocates along the guide members 4 and 5.

Figure 2A:
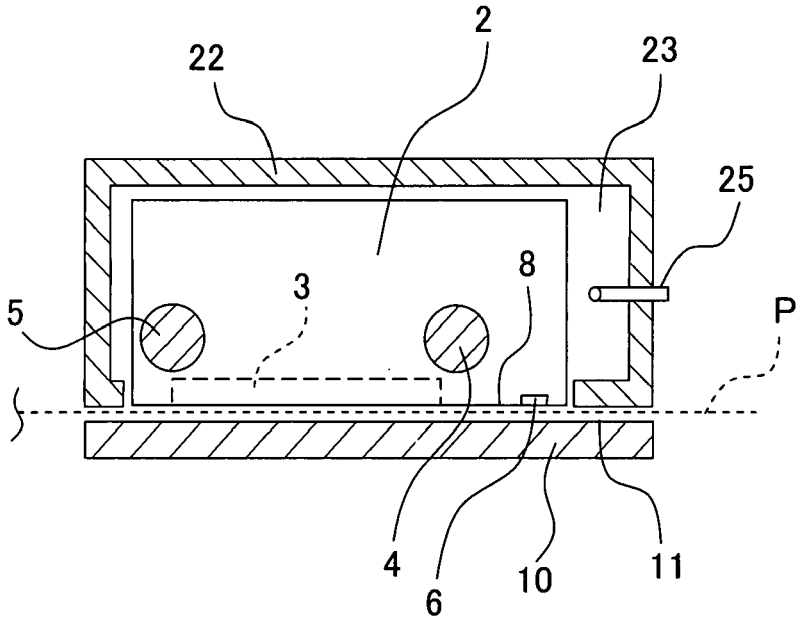
FIG. 2A is a cross-sectional view taken along a line IIA-IIA in FIG. 1.
Figure 2B:
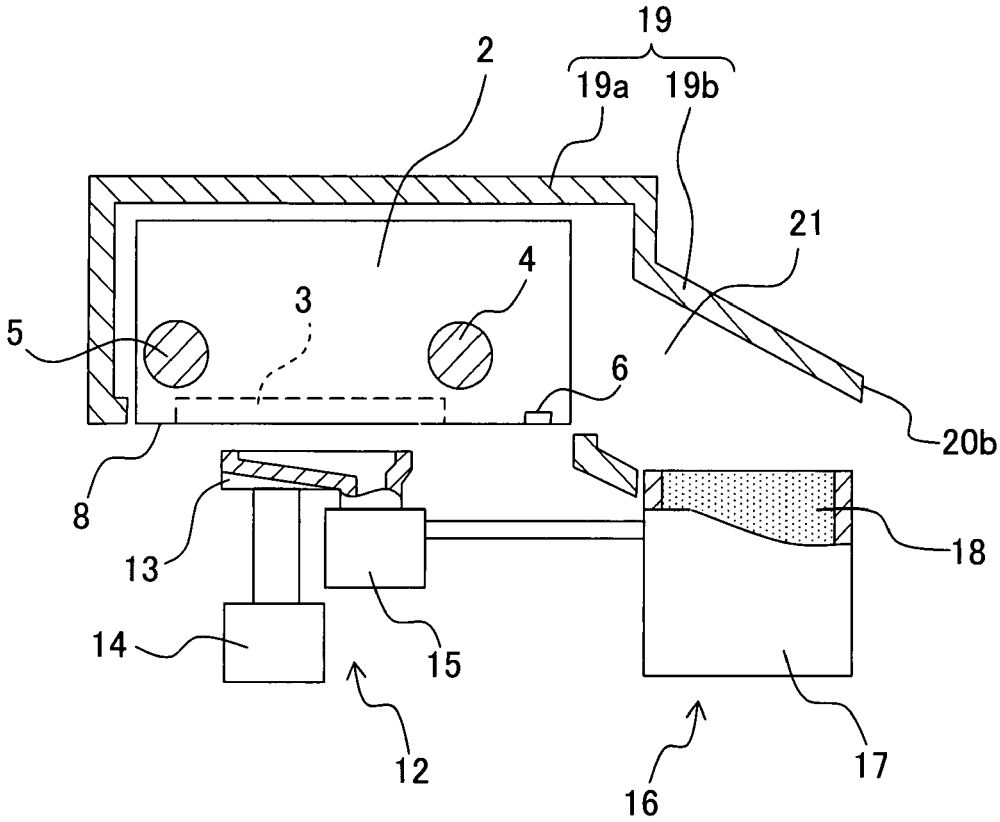
FIG. 2B is a cross-sectional view taken along a line IIB-IIB in FIG. 1.

As shown in FIG. 2A, the recording head 3 is installed on a surface, of the carriage 2, facing a recording paper P which is transported in the secondary scanning direction. Moreover, a plurality of nozzle groups 9 which jet inks of plurality of colors is provided on a surface (nozzle surface) 8, of the recording head 3, facing the recording paper P. As shown in FIG. 2A, the ink-jet image forming apparatus (ink-jet printer) 1 has a platen 10 which is arranged facing the recording head 3. A surface of the platen 10 facing the recording head 3 is a paper transporting surface 11, and is arranged to have a slight gap from the nozzle surface 8 of the recording head 3. The recording paper P is supported by the paper transporting surface 11 of the platen 10.

As shown in FIG. 1, a maintenance unit 12 is arranged at one end of a traveling passage of the carriage 2. As shown in FIG. 2B, the maintenance unit 12 includes a cap 13 which is capable of covering the nozzle groups 9 entirely by making a contact with the nozzle surface 8 of the recording head 3, an elevator (elevating unit, ascending and descending unit) 14 which brings closer and separates away the cap 13 to and from the nozzle surface 8 of the recording head 3, and a suction pump 15 which sucks the ink from each of the nozzle groups 9 covered by the cap 13.

In the maintenance unit 12, it is possible to carry out a purge process, a flushing process, and preservation of nozzles included in each of the nozzle groups. The purge process is a process which facilitates a maintenance and recovery of a jetting function by discharging impurities such as thickened ink inside the nozzles and/or an ink supply channel, by sucking the ink from the nozzles of the nozzle groups 9. The flushing process is a process which facilitates a maintenance and recovery of the jetting function by jetting the ink toward the cap 13 from each of the nozzle groups 9, irrespective of recording data. The preservation of the nozzles prevents drying of ink inside the nozzles when not in use.

Waste-ink discharged by the purge process in the maintenance unit 12 is sent from the suction pump 15 to the waste-ink tank 16, and stored. The waste-ink tank 16 is a tank in which an absorbing body 18 which is porous is accommodated in a container (receptacle) 17 in the form of a box with an upper surface opened, and the waste-ink is absorbed in this absorbing body 18.

Furthermore, an air guide section 19 which guides a flow of air generated by a movement of the carriage 2 to the waste-ink tank 16 is provided to the ink-jet image forming apparatus 1. The air guide section 19 has a main portion 19*a* and blowing portion 19*b*. The main portion 19*a* has a substantially cylindrical shape and is extended in the main scanning direction. Furthermore, the main portion 19*a* covers the carriage 2 and the traveling passage of the carriage 2. The blowing portion 19*b* is extended from one end of the main portion 19*a* toward the waste-ink tank 16. In other words, the air guide section 19 is arranged covering the maintenance unit 12 and the waste-ink tank 16. Two openings (apertures) are formed in the air guide section 19. As shown in FIG. 1, a first opening 20*a* is formed at an end of the main portion 19*a*, on a side of the maintenance unit 12 of the traveling passage of the carriage 2, and is opened toward the main scanning direction. As shown in FIG. 2B, a second opening 20*b* is formed at a position of the blowing portion 19*b*, facing an upper surface of the waste-ink tank 16. The ink-jet image forming apparatus 1 communicates with an outside by this second opening 20*b*. The first opening 20*a* directed toward the main scanning direction has a size which allows the carriage 2 to pass through. An air blowing passage 21 which guides the air generated by the movement of the carriage 2 to the waste-ink tank 16 is formed at an inner side of the air guide section 19.

Moreover, a cover 22, which covers whole of the carriage 2 and the traveling passage of the carriage 2 integrally with the air guide section 19, is connected to the first opening 20*a* of the air guide section 19. The cover 22 has a wall surface which covers each of a front and rear surfaces (front and rear in the secondary scanning direction), and an upper surface which is parallel to the traveling passage of the carriage 2. A slight gap through which the recording paper P passes is formed between a lower end of the wall of the front and rear surface of the cover 22, and the paper transporting surface 11 of the platen 11. An air blowing passage 23 is formed in the cover 22 in combination with the paper transporting surface 11 of the platen 10. The air blowing passage 23 is elongated in a direction of traveling of the carriage 2, and communicates with the air blowing passage 21 of the air guide 19.

In this embodiment, an ink cartridge 24 which stores the ink is detachably mounted (installed) at a stationary position inside the ink-jet image forming apparatus 1, outside of the carriage 2. The ink cartridge 24 supplies the ink to the recording head 3 through the flexible tube 25, via a buffer tank not shown in the diagram, which is mounted on the carriage 2. The flexible tube 25 which is pierced (passed) through a portion of the cover 22, at almost a center of a traveling range of the carriage 2, is extended from an outside to an inside of the cover 22, and is bent in the form of "U" in the direction of travel of the carriage 2. It is also possible to mount the ink cartridge on the ink carriage 2 as it has been known.

Figure 5:
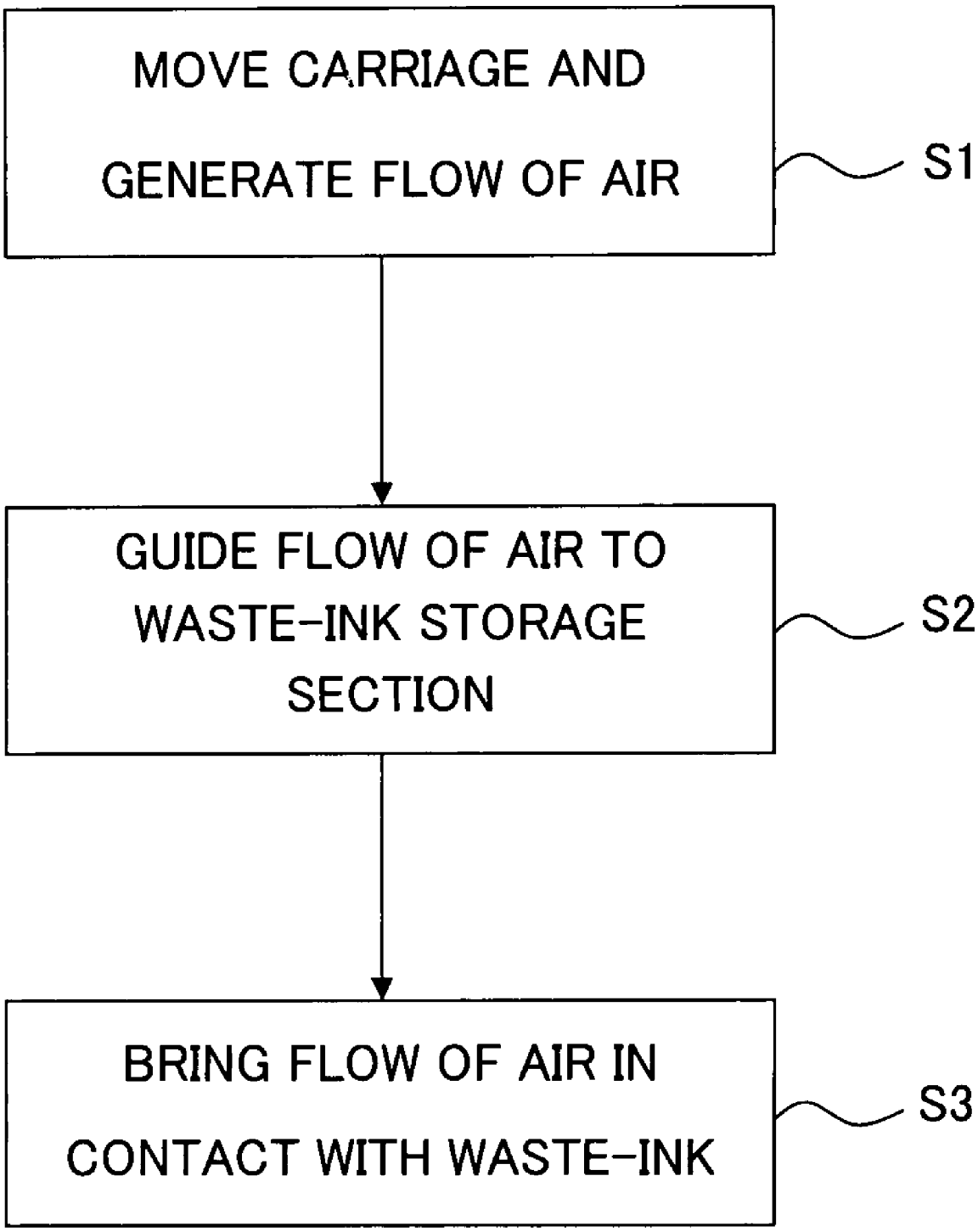
FIG. 5 is a flowchart describing a waste-ink disposal method according to the present invention.

Next, a method of processing the waste-ink collected in the waste-ink tank 16, in the ink-jet image forming apparatus 1 will be described with reference to FIG. 5. Firstly, when the carriage 2 of the ink-jet image forming apparatus 1 is moved toward the maintenance unit 12 of the traveling passage, a flow of air in a direction of the air guide section 19 is generated in the air blowing passage 23 of the cover (step S1). This air flows into the air guide section 19. The air flowed into the air guide section 19 flows through the air blowing section 21, and is released (discharged) to an outside of the air guide section 19 from the second opening 20*b* at the side of the waste-ink tank 16 in the air guide section 19 (step S2). Evaporation of the waste-ink is expedited by bringing in contact the waste-ink absorbed into the absorbing body 18 of the waste-ink tank 16, and the air released from the air guide section 19.

Even when the carriage 2 is moved in a direction opposite to the maintenance unit 12, a flow of air in a direction going away from the air guide section 19 is generated in the cover 22 (step S1). As a result of this, a flow of air is generated such that the air is drawn from the second opening 20*b*, at the side of the waste-ink tank 16 in the air guide section 19, toward the inside of the air blowing passage 21 (step S2). At this time, the evaporation of the waste-ink is expedited by bringing in contact the waste-ink in the waste-ink tank and the air drawn into the air guide section 19 (step S3).

Since the ink-jet image forming apparatus 1 has the air guide section 19 and the cover 22, it is possible to accelerate the evaporation of the waste-ink by guiding efficiently the flow of the air generated by the movement of the carriage 2, to the waste-ink tank 16. Moreover, since the waste-ink is made to be susceptible to be evaporated by absorbing in the absorbing body 18 which is porous, the waste-ink tank 16 is small sized, and the receiving capacity of the waste-ink is high.

Moreover, since the air which is sent toward the waste-ink tank 16 becomes warm due to heat generated by the recording head 3 as a result of a jetting operation of the recording head 3, and heat generated by a driver circuit for driving the recording head 3 mounted on the carriage 2, the evaporation of the waste-ink is further accelerated.

Figure 3:
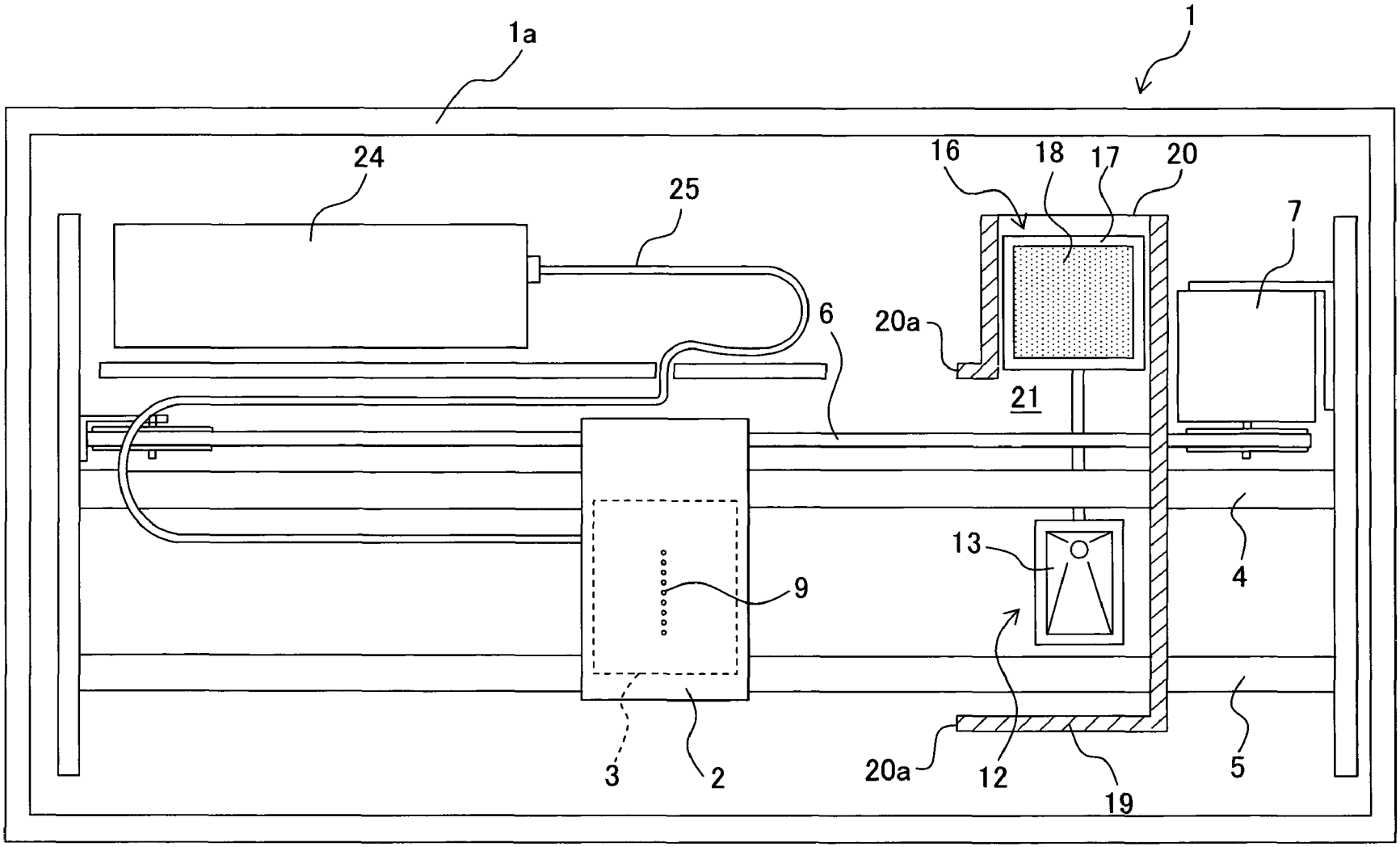
FIG. 3 is a schematic plan view showing another embodiment of the ink-jet image forming apparatus according to the present invention.

As shown in FIG. 3, it is also possible to let the ink-jet image forming apparatus 1 to have a simple structure having the air guide section 19, but not having a cover connected to the air guide section 19.

In the ink-jet image forming apparatus 1 having such structure, when the carriage 2 moves toward the maintenance unit 12, a flow of air toward the air guide section 19 is generated as a result of the movement of the carriage 2. The air flows from an opening 26 of the air guide section 19, directed toward the main scanning direction, and passes through the air blowing passage of the air guide section 19. At this time, since the air coming out from the opening 20*a* toward the waste-ink tank 16, and the waste-ink in the waste-ink tank come in contact, the evaporation of the waste-ink is expedited.

Moreover, even in a case of the carriage 2 moving in a direction opposite to the maintenance unit 12, when the carriage 2 moves from a position on the inner side of the air guide section 19, or from a position close to the air guide section 19, a flow of air from the first opening 20*a* on the side of the waste-ink tank 16 in the air guide section 19, toward the second opening 20*b* is generated. Even in this case, since the air flowing into the air blowing section 21 from the first opening 20*a* on the side of the waste-ink tank 16, and the waste-ink come in contact, the evaporation of the waste-ink is expedited.

Figure 4:
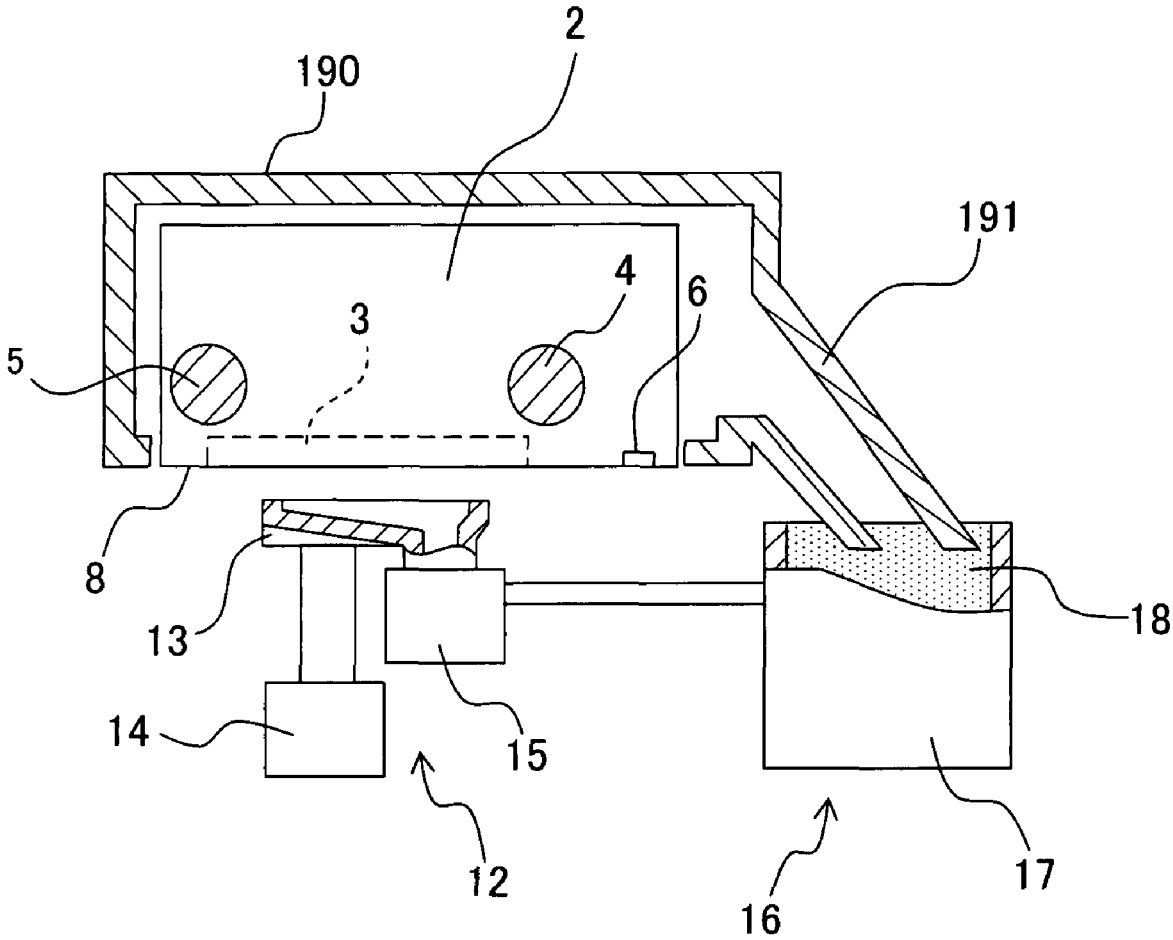
FIG. 4 is a diagram corresponding to FIG. 2B, of an air guide section having an extended portion.

A position of the opening of the air guide section may be arbitrary irrespective of the abovementioned embodiment. For example, the opening of the air guide section, which is arranged at a position opposite to the waste-ink tank in the abovementioned embodiment, can be arranged in a side of the traveling passage of the carriage. Moreover, the opening of the air guide section, on the side of the waste-ink tank 16, was facing the waste-ink tank 16 in the abovementioned embodiment. As shown in FIG. 4, an air guide section 190 may have an extended portion (extended nozzle) 191 which is extended up to the inside of the container 17 of the waste-ink tank 16. In this case, since the air passed through the air guide section 190 is sent up to the inside of the container 17, it is possible to expedite the evaporation of the waste-ink which is absorbed in the absorbing body 18 arranged inside the container 17. Here, the extended portion 191 may be arranged around the absorbing body 18, inside the container 17, or may be inserted into the absorbing body 18. Moreover, the ink-jet image forming apparatus may not necessarily include the body cover 1A. When the ink-jet image forming apparatus has the body cover 1A, the air guide section may be formed independently from the body cover, or may be formed integrally with the body cover. Furthermore, in the abovementioned embodiment, the ink is discharged toward the cap 13 in the flushing process. However, it is also possible to juxtapose the waste-ink tank exclusively for the flushing process, on the cap 13.

In the embodiment, the air guide section 19 was a hollow cylindrical-shaped member having a shape of an English alphabet L and including the main portion and the blowing portion. However, the air guide section may have an arbitrary shape, provided that the air guide section is capable of guiding the flow of the air, generated as a result of the movement of the carriage, to the waste-ink tank. For example, in the embodiment, the blowing portion was substantially circular shaped. However, without restricting to be substantially circular shaped, the blowing portion may be a fin which guides the air toward the waste-ink tank. Moreover, a material of the air guide section may be arbitrary. Furthermore, in the embodiment, a porous absorbing body is used as the absorbing body in the waste-ink tank. However, an arbitrary absorbing body may be used, provided that the absorbing body may absorb a liquid, and may be held inside. For example, a material such as a non-woven fabric and felt may be used as the absorbing body.

What is claimed is:

1. An ink-jet image forming apparatus which forms an image by discharging an ink onto a medium, comprising:

a recording head in which a plurality of nozzles which jet the ink is formed;

a carriage which has the recording head mounted thereon, and which moves reciprocally in a predetermined direction;

a waste-ink tank which stores the ink discharged from the nozzles; and a guide section which guides an air flow, generated when the carriage moves to the waste-ink tank to bring the air flow into contact with the ink stored in the waste-ink tank;

wherein the guide section includes an air blowing passage which has a substantially cylindrical shape, and of which one end faces a traveling route in which the carriage reciprocally moves and the other end of which faces the waste-ink tank.

2. The ink-jet image forming apparatus according to claim 1;

wherein the air blowing passage is arranged at an end of the traveling route, or at an extension of the traveling route such that the one end is directed in the predetermined direction.

3. The ink-jet image forming apparatus according to claim 1, further comprising:

a cover which covers whole of the traveling route of the carriage together with the carriage;

wherein the one end of the air blowing passage of the guide section communicates with an inside of the cover.

4. The ink-jet image forming apparatus according to claim 3, further comprising:

a transporting member in which a transporting surface, which faces the carriage and on which the medium is transported, is formed;

wherein the cover is positioned close to the transporting surface, and the cover and the transporting surface are combined to form a second air blowing passage, which is elongated in the predetermined direction and which communicates with the air blowing passage of the guide section.

5. The ink-jet image forming apparatus according to claim 3, further comprising:

an ink cartridge which is arranged outside the cover; and a flexible tube through which the ink in the ink cartridge is supplied to the recording head, and which connects the ink cartridge arranged outside the cover and the recording head arranged inside the cover.

6. The ink-jet image forming apparatus according to claim 1;

wherein the waste-ink tank has a container and an absorbing body which is porous and which is accommodated in the container.

7. The ink-jet image forming apparatus according to claim 1, further comprising:

a body cover which covers the recording head, the carriage, the waste-ink tank, and the guide section.

8. An ink-jet image forming apparatus which forms an image by discharging an ink onto a medium, comprising:

a recording head in which a plurality of nozzles which jet the ink is formed;

a carriage which has the recording head mounted thereon, and which moves reciprocally in a predetermined direction;

a waste-ink tank which stores the ink discharged from the nozzles;

a guide section which guides an air flow, generated when the carriage moves to the waste-ink tank to bring the air flow into contact with the ink stored in the waste-ink tank;

a maintenance unit which is arranged at an end of the traveling passage in which the carriage moves reciprocally, the maintenance unit recovering a jetting function of the recording head by a purge process in which the ink is sucked by the maintenance unit or the ink is discharged to the maintenance unit; and a waste-liquid discharge passage which discharges the ink discharged from the maintenance unit to the waste-ink tank.

9. An ink-jet image forming apparatus which forms an image by discharging an ink onto a medium, comprising:

a recording head in which a plurality of nozzles which jet the ink is formed;

a carriage which has the recording head mounted thereon, and which moves reciprocally in a predetermined direction;

a waste-ink tank which stores the ink discharged from the nozzles; and a guide section which guides an air flow, generated when the carriage moves to the waste-ink tank to bring the air flow into contact with the ink stored in the waste-ink tank;

wherein the guide section includes a main portion which is extended in the predetermined direction to cover the carriage, and a blowing portion which is extended in the predetermined direction from one end of the main portion toward the waste-ink tank.

10. The ink-jet image forming apparatus according to claim 9;

wherein the blowing portion of the guide section is extended up to an inside of the container of the waste-ink tank.

11. The ink-jet image forming apparatus according to claim 10;

wherein the blowing portion of the guide section is inserted into the absorbing body accommodated in the container.

12. A waste-ink processing method for processing a waste-ink in an ink-jet image forming apparatus including a carriage which is capable of reciprocating in a predetermined direction, a recording head which is provided on the carriage and in which a plurality of nozzles is formed, and a waste-ink tank which stores the waste-ink discharged from the nozzles, the method comprising:

generating an air flow by moving the carriage; and guiding the air flow to the waste-ink tank to bring the air flow in contact with the waste-ink stored in the waste-ink tank, by a guide section which is provided with the ink-jet image forming apparatus and which guides the air flow generated when the carriage moves;

wherein the guide section includes an air blowing passage which has a substantially cylindrical shape, and of which one end faces a traveling route in which the carriage reciprocally moves and the other end of which faces the waste-ink tank.

* * * * *